US005165155A

United States Patent [19]

Adams

[11] Patent Number: 5,165,155

[45] Date of Patent: Nov. 24, 1992

[54] ARCHERY BOW PLIERS

[76] Inventor: James D. Adams, 41113 Southwind, Canton, Mich. 48188

[21] Appl. No.: 760,886

[22] Filed: Sep. 16, 1991

[51] Int. Cl.[5] ..... B25B 27/00

[52] U.S. Cl. ..... 29/268; 29/253; 29/283.5

[58] Field of Search ..... 29/253, 267, 268, 270, 29/283.5; 81/419, 424.5, 426

[56] References Cited

U.S. PATENT DOCUMENTS

| | | | |
|---|---|---|---|
| 1,067,876 | 7/1913 | Merritt . | |
| 1,948,365 | 2/1934 | Miller et al. | 128/332 |
| 2,254,410 | 9/1941 | Burns | 140/113 |
| 2,478,881 | 8/1949 | Wayrymen | 29/268 |
| 2,562,097 | 7/1951 | Heuer | 81/15 |
| 3,401,444 | 9/1968 | Kovacs | 29/268 |
| 4,617,710 | 10/1986 | Kotnik | 29/268 |
| 5,022,292 | 6/1991 | Hammer et al. | 29/268 |

FOREIGN PATENT DOCUMENTS

| | | | |
|---|---|---|---|
| 464291 | 4/1950 | Canada | 29/268 |
| 3421986 | 12/1985 | Fed. Rep. of Germany | 29/268 |

*Primary Examiner*—J. J. Swann

*Attorney, Agent, or Firm*—Charles W. Chandler

[57] ABSTRACT

Archery bow pliers for removing a split nock ring from a bow string. The archery bow pliers have a wedge and anvil which are formed to open a split nock ring along its longitudinal cleft, allowing the split nock ring to be removed from a bow string without damaging the bow string or unnecessarily deforming the split nock ring. The archery bow pliers have an anvil member and a wedge member which are pivotably attached to one another. The anvil member has an anvil surface formed adjacent one end. A wedge defined by two converging surfaces is formed on one end of the wedge member corresponding to the anvil surface on the anvil member. Each converging surface engages one free end of the split nock ring on either side of the cleft to wedge the free ends apart sufficiently to allow the bow string to pass therethrough. The split nock ring can then be removed from the bow string and either replaced or relocated on the bow string. The anvil member is also provided with a channel for positioning and guiding the archery bow pliers relative to the bow string in a manner that spaces the bow string from the wedge so as to prevent the wedge from damaging the bow string during removal of the split nock ring.

6 Claims, 2 Drawing Sheets

ARCHERY BOW PLIERS

BACKGROUND OF THE INVENTION

1. FIELD OF THE INVENTION

The present invention generally relates to pliers used to grasp and deform articles such as metal clasps. More specifically, this invention relates to archery bow pliers adapted for both attaching and removing a split nock ring from a bow string.

2. DESCRIPTION OF THE PRIOR ART

Split nock rings are commonly used by archers to accurately locate the rearward end of an arrow on the bow string. The rearward end of the arrow has a diametral groove, referred to as a nock, which is positioned below the split nock ring on the bow string so as to accurately and repeatably locate the arrow on the bow string. By positioning the arrow accurately with respect to the bow string, and thus also with respect to the bow, the arrow's trajectory can be better predicted, thereby providing improved precision of the archer's aim.

Typically, the split nock ring is annular-shaped with an axial length of approximately ⅛ inches. The split nock ring is formed of a resilient metal, such as brass, having a thickness of approximately 1/32 inches. The split ring is generally U-shaped with a longitudinal cleft which forms a passage or split in the side of the nock ring through which the bow string is passed when installing the nock ring on the bow string. Prior to installation, both the width of the cleft and the inner diameter of the split nock ring are approximately equal to the outer diameter of the bow string, which is typically about ⅛ inch in diameter. Once positioned on the bow string, the split nock ring is compressed on its circumference with a suitable tool to collapse its inner diameter, causing the split nock ring to crimp tightly around the bow string. The interference caused by the crimping permanently maintains the split nock ring at its installed location on the bow string until the split nock ring is forcibly removed.

Split nock rings typically need to be replaced or relocated on occasion, requiring that the cleft in the nock ring be reopened to allow removal of the nock ring from the bow string. The process of removing the nock ring is complicated in that removal must be accomplished without damaging the bow string. Where the nock ring is merely being relocated, minimal harm to the split nock ring is also preferable to allow the split nock ring to be reused.

Bow strings typically consist of a number of tightly-wound strands which are often protected with a nylon thread wrapped around the bow string in the area where the split nock ring, and thus the arrow, is positioned. This protective wrap is particularly vulnerable to damage while the split nock ring is being removed. Common methods of removing split nock rings, such as with the use of conventional pliers or other commonly available tools capable of prying the cleft apart, are undesirable for this reason. The user cannot adequately control the tool while simultaneously positioning it with respect to the bow string. Consequently, many attempts are often necessary to remove the split nock ring, and then such attempts often do not entirely avoid damaging either the bow string or the split nock ring.

Specially adapted pliers for crimping split nock ring on bow strings are well known in the art. Typically, split nock ring crimping pliers are formed with two semi-circular recesses, one on each half of the plier jaws, which are sized to define the crimped diameter of the split nock ring. The split nock ring can then be loaded into the recesses, positioned around the bow string by passing the bow string through the cleft, and then crimped by bringing the two halves of the pliers together.

Similarly, such special adaptations are commonly devised for pliers which are intended to be used as a crimping tool. Examples of known modifications made to pliers to facilitate a crimping action can be seen in U.S. Pat. Nos. 2,562,097 to Heuer, 2,254,410 to Burns, 1,948,865 to Miller et al, and 1,067,876 to Merritt. Each represents an approach to accomplishing a particular crimping operation. However, all of these tools, including the conventional split nock ring crimping pliers known to the prior art, are adapted for crimping and are not intended or even suggested to be useful for splitting a ring open after being crimped closed. Again, removal of the split nock rings from bow strings is typically achieved by such awkward tools as common pliers or prying tools.

Therefore, a device is needed which can remove a split nock ring from a bow string without damaging the bowstring and without excessively deforming the split nock ring such that it can be reused.

SUMMARY OF THE INVENTION

The present invention provides a pair of pliers having a wedge and anvil feature formed to open a split nock ring along its longitudinal cleft, allowing the split nock ring to be removed from a bow string. Of primary importance, the pliers of the present invention are capable of removing the split nock ring without damaging the bow string or excessively deforming the split nock ring itself. In addition, the pliers also have a crimping feature capable of installing the split nock ring onto the bow string.

In particular, the pliers of the present invention consist of a first and second member which are pivotably attached to one another. The first and second members are preferably elongate and pivotably attached at a point close to a pair of corresponding working ends on the first and second members so as to afford a sufficient mechanical advantage when splitting a split nock ring. The first member has an anvil formed on its working end. A wedge is formed on the working end of the second member which, in cooperation with the anvil, can be forcibly engaged with the longitudinal cleft in the split nock ring by a user to open the cleft sufficiently for removing the split nock ring from the bow string.

In the preferred embodiment of the present invention, the working end of the first member has a feature for positioning and guiding the pliers relative to the bow string. This feature is preferably a channel formed in the distal end surface of the first member. In use, the bow string is placed in this channel to properly orient the pliers with respect to the bow string and the split nock ring attached to the bow string. The channel is oriented on the first member's end surface so as to be relative to the first member. The first member is slightly longer than the second member such that, when the first and second members are juxtaposed, the wedge of the second member abuts the anvil of the first member, while the bottom of the channel extends slightly below the wedge of the second member. This arrangement maintains the bow string beyond the reach of the wedge and anvil while the user is removing the split nock ring with the pliers. In addition, the location of the channel beyond the wedge and anvil allows the pliers to be properly positioned relative to the split nock ring irrespective of the diameters of either the bow string or split nock ring.

In use, the pliers are first oriented to be in the plane of the bow string. The first member is then placed against the bow string such that the channel engages the bow string and with the first and second members positioned on opposite sides of the split nock ring. The pliers are then further oriented with respect to the split nock ring such that the wedge is positioned to engage the split nock ring's longitudinal cleft. As the working ends of the first and second members are rotated toward each other, the anvil of the second member abuts one end of the split nock ring while the wedge is driven into the longitudinal cleft from the opposite end so as to open the split nock ring. Further rotation of the first and second members acts to fully open the longitudinal cleft such that the split nock ring can be removed from the bow string.

An advantage to the pliers of the present invention is that the split nock ring can be readily removed from the bow string without damaging the bow string or excessively deforming the split nock ring. The channel or excessively deforming the split nock ring. The channel is formed to be sufficiently spaced from the wedge and anvil to accommodate most conventionally-sized bow strings and split nock rings. Further, the channel helps position and steady the pliers as they are manipulated by the user while removing the split nock ring. This feature also helps prevent damage to the bow string.

Accordingly, it is an object of the present invention to provide a device for removing a split nock ring from a bow string. The present invention accomplishes this object by providing pliers having a wedge and anvil for engaging and opening the longitudinal cleft of the split nock ring to allow its removal from a bow string.

It is a further object of this invention to provide pliers for removing a split nock ring from a bow string which can be accurately positioned relative to the split nock ring and the bow string to minimize damage to both the bow string and the split nock ring.

It is still a further object of this invention to provide pliers which can be used on split nock rings and bow strings of various conventional sizes.

It is yet a further object of this invention to provide pliers which are inexpensive and can be easily used by a single operator.

It is still another object of this invention to provide pliers for removing a split nock ring from a bow string which is also adapted to install a split nock ring on a bow string.

Other objects and advantages of this invention will be more apparent after a reading of the following detailed description taken in conjunction with the drawings provided.

BRIEF DESCRIPTION OF THE DRAWINGS

The description refers to the accompanying drawings in which like reference characters refer to like parts throughout the several views, and in which.

DETAILED DESCRIPTION OF THE PREFERRED EMBODIMENT

Figure 1:
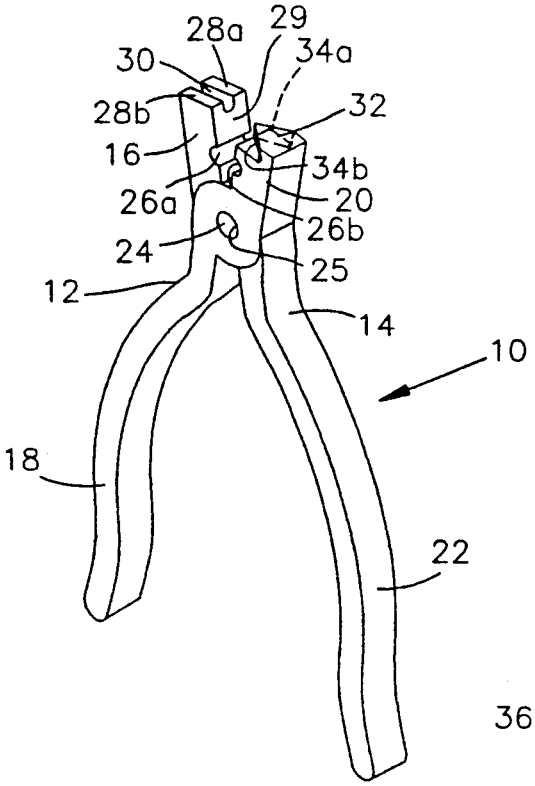
FIG. 1 is a perspective view of archery bow pliers according to the preferred embodiment of the present invention.

Referring to FIGS. 1 through 6, there is provided archery bow pliers 10 for removing a split nock ring 38 from a bow string 36 of a bow (not shown). As best seen in FIG. 1, the archery bow pliers 10 include a wedge member 12 and an anvil member 14 which are pivotably attached at a pivot 24. Pivot 24 can be of any conventional construction, such as that indicated in FIG. 1 in which wedge and anvil members 12 and 14 cross over each other at a point adjacent corresponding working ends 20 and 16 of each of wedge and anvil members 12 and 14. As illustrated, anvil member 14 has a cylindrical extension which constitutes pivot 24 while wedge member 12 has an aperture 25 which is pivotably secured to pivot 24 of wedge member 12. Locating pivot 24 adjacent corresponding working ends 16 and 20 provides adequate leverage at the opposite ends 18 and 22 of wedge and anvil members 12 and 14, respectively, to achieve the operational purpose of the present invention.

Both wedge and anvil members 12 and 14 are elongated. Ends 18 and 22 serve as handles for wedge and anvil members 12 and 14, respectively. Working end 20 of wedge member 12 constitutes a wedge end 20 which is oppositely disposed from handle 18, while working end 16 of anvil member 14 constitutes an anvil end 16 Which is oppositely disposed from handle 22. Anvil end 16 extends further from pivot 24 than wedge end 20, as can most readily be seen in FIG. 5.

With reference again to FIG. 1, wedge end 20 is formed with a wedge 32 which faces anvil end 16 of anvil member 14. Wedge 32 is defined by two converging surfaces **34*a* and 34*b* which together form the working surfaces of wedge 32. As shown with greater detail in FIG. 6, wedge surfaces 34*a* and 34*b* are inwardly inclined so as to provide a more reliable engagement with split nock ring 38**, as will be explained more fully below.

Figure 4:
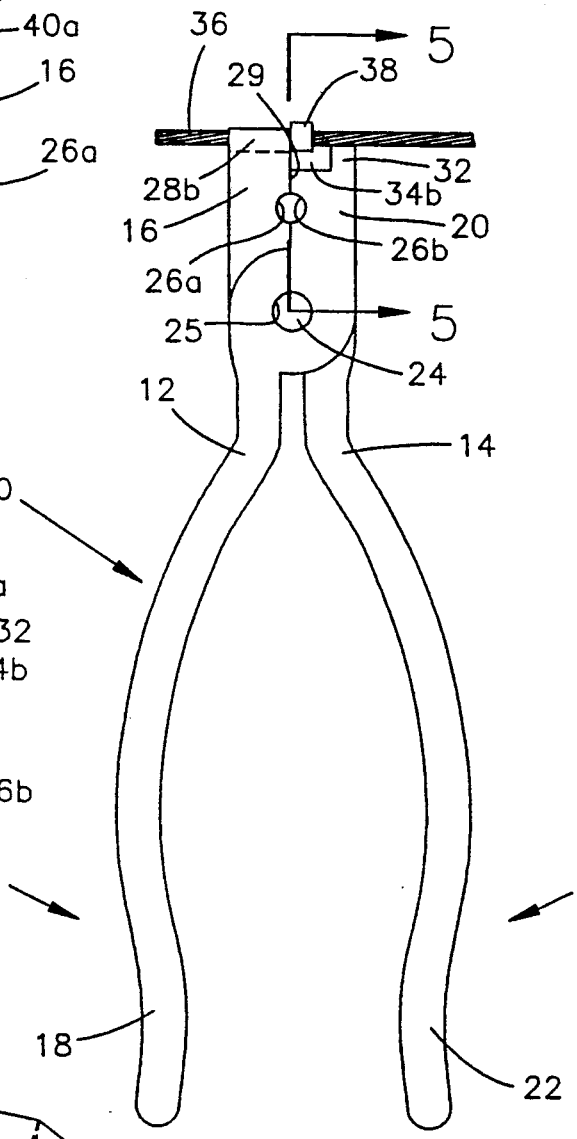
FIG. 4 is a front view of the archery bow pliers of FIG. 1 as positioned after the longitudinal cleft of the split nock ring has been engaged by the wedge of the archer bow pliers, allowing the split nock ring to be removed from the bow string.

With reference again to FIG. 1, a channel 30 is formed on the distal surface of anvil end 16, dividing anvil end 16 into two anvil portions **28*a* and 28*b* which face wedge 32. Channel 30 is sized to be wide enough to accommodate all conventional bow strings 36 while being smaller than the outer diameter of split nock ring 38. As shown, channel 30 is oriented on anvil end 16 such that it is parallel to the arc of wedge member 12 when wedge member 12 is rotated relative to anvil member 14. As previously noted, anvil end 16 extends sufficiently beyond wedge end 32 when wedge and anvil members 12 and 14 are rotated to be adjacent each other. As can be seen in FIG. 4, wedge 32 extends slightly past the edge of channel 30 so as to ensure sufficient contact of wedge 32 with split nock ring 38**.

An anvil surface 29 is located on anvil end 20 so as to abut wedge 32 when wedge member 12 and anvil member 14 are juxtaposed.

A pair of semi-circular crimping surfaces 26*a* and 26*b* are also provided on anvil end 16 and wedge end 20, respectively, adjacent pivot 24. Crimping surfaces 26*a* and 26*b* are formed to define a minimum diameter when joined for crimping the outer diameter of the smallest conventionally-sized split nock ring 38. When anvil end 16 and wedge end 20 are brought together, crimping surfaces 26*a* and 26*b* converge upon the outer diameter of split nock ring 38, collapsing split nock ring 38, collapsing split nock ring 38 to a smaller diameter which fits tightly to bow string 36. The semicircular edges formed by crimping surfaces 26*a* and 26*b* on their respective working ends 16 and 20 are rounded so as to prevent accidental damage to bow string 36 while split nock ring 38 is being attached.

Figure 2:
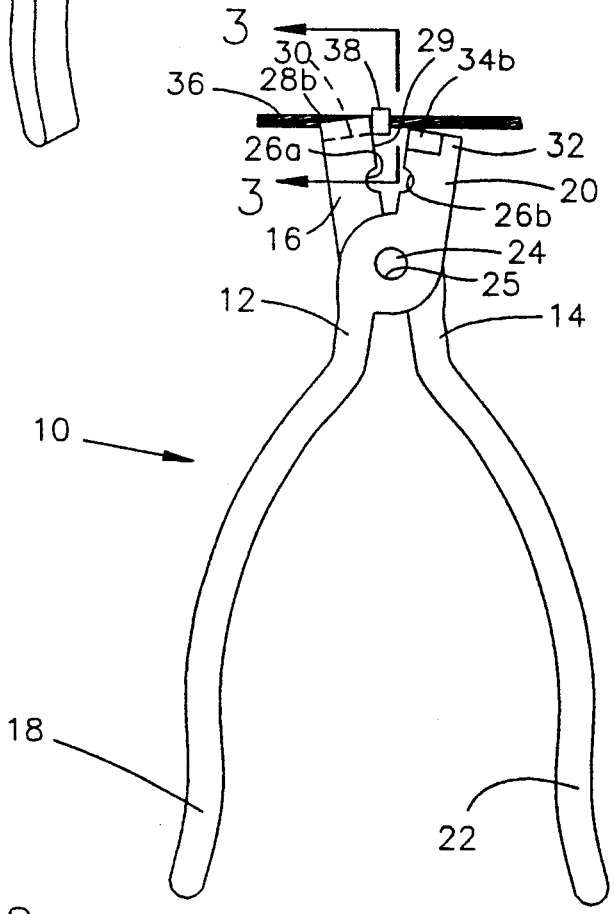
FIG. 2 is a front view of the archery bow pliers of FIG. 1 in position to remove a split nock ring from a bow string.
Figure 3:
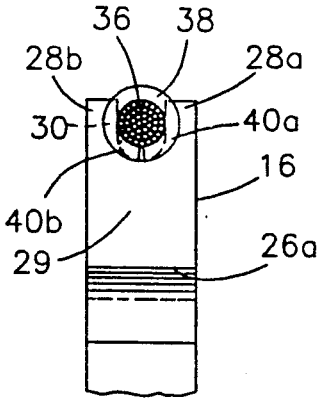
FIG. 3 is a cross-sectional view of the archery bow pliers of FIG. 2 taken along line 3—3.

In operation, to remove split nock ring 38 from bow string 36, archery bow pliers 10 are brought into position, as illustrated in FIG. 2, such that channel 30 engages bow string 36 on one end of split nock ring 38 while wedge 32 is positioned adjacent the opposite end of split nock ring 38. As can be seen in FIG. 3, in the initial position anvil surface 29 provides a support surface upon which split nock ring 38 is positioned. Archery bow pliers 10 are then further positioned such that free ends 40*a* and 40*b* of split nock ring 38 face toward the body of archery bow pliers 10, aligning the longitudinal cleft defined by free ends 40*a* and 40*b* with wedge 32.

Figure 5:
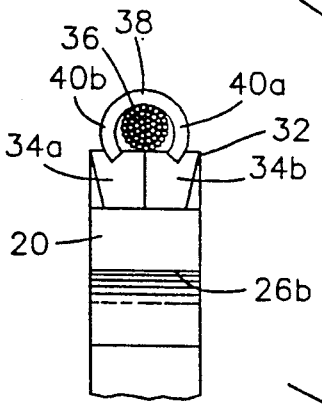
FIG. 5 is a cross-sectional view of the archery bow pliers of FIG. 4 taken along line 5—5.
Figure 6:
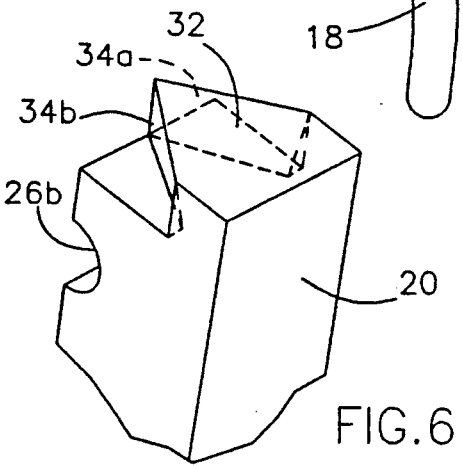
FIG. 6 is a perspective view of the wedge end of the archery bow pliers of FIG. 1 illustrating with greater detail the shape of the wedge according to the preferred embodiment of the present invention.

The cleft in split nock ring 38 is then expanded by rotating wedge end 20 toward anvil end 16, as indicated by the arrows in FIG. 4, engaging free ends 40*a* and 40*b* with wedge surfaces 34*b* and 34*a*, respectively. During operation, the inclined orientation of wedge surfaces 34*a* and 34*b* act to maintain full engagement of wedge 32 with free ends 40*a* and 40*b* by preventing split nock ring 38 from slipping toward distal end of wedge 32. In effect, wedge surfaces 34*a* and 34*b* act to urge free ends 40*a* and 40*b* in a direction away from bow string 36. Further rotation ultimately forces wedge 32 to come into contact with anvil surface 29, as illustrated by FIG. 4, which further spreads free ends 40*a* and 40*b*. As best seen in FIG. 5, wedge surfaces 34*a* and 34*b* to force free ends 40*a* and 40*b* ends 40*a* and 40*b*, allowing split nock ring 38 to be removed from bow string 36.

An advantage to the present invention is that channel 30 is spaced from wedge 32 and anvil surface 29 such that wedge 32 cannot damage bow string 36 while split nock ring 38 is being removed. As can be seen in FIG. 4, wedge 32 extends slightly beyond the innermost point of channel 30 s o as to ensure that the wedge 32 can be fully engaged with split nock ring 38. However, in cooperation with channel 30, the engagement of wedge 32 with split nock ring 38 can be controlled so as to avoid damage to bow string 36 when positioned within channel 30. This is particularly advantageous in that any conventionally-sized split nock ring 38 can be removed cleanly from bow string 36, regardless of the diameter of bow string 36 as long as the bow string diameter is a conventional size which can be accommodated within channel 30. Obviously, archery bow pliers 10 can be made to fit any sized bow string 36 and split nock ring 38 by those skilled in the art.

Another advantage is that channel 30 assists in positioning and steadying archery bow pliers 10 when being handled by a user for removing split nock ring 38. This capability further prevents damage to bow string 36 in that the position of wedge 32 and anvil surface 29 relative to bow string 38 can be maintained throughout the operation.

While the invention has been described in terms of a preferred embodiment, it is apparent that other forms could be adopted by one skilled in the art. Accordingly, the scope of the invention is to be limited only by the following claims.

Having described my invention, I claim:

1. A pliers-like hand tool for removing a split nock ring from a bow string, the split nock ring having a pair of abutting edges forming a seam parallel to the longitudinal axis of the bow string, the seam having ends terminating in first and second spaced, annularly-shaped nock ring ends disposed around the bow string, the pliers-like hand tool comprising:

a first member;

anvil means disposed on the first member, the anvil means having an anvil surface forming stop means for seating the first annularly-shaped nock ring end;

a second member pivotally connected to the first member;

wedge means disposed on the second member, the wedge means having an engaging surface aligned with the stop means to engage the second annularly-shaped nock ring end adjacent the seam of the nock ring, the wedge means being movable toward the stop means as the first and second members are pivoted with respect to one another toward a closed position, whereby the wedge means moves along the seam to open the nock ring in a motion of the wedge means in a direction substantially parallel to the bow string.

2. A pliers-like hand tool as defined in claim 1, in which the wedge means has a substantially pointed wedge-shaped end.

3. The archery bow pliers of claim 1 wherein the guide means is a channel formed on the working end of the first member, the channel being sized to accommodate the diameter of the bow string.

4. The archery bow pliers of claim 1 wherein the wedge means comprises a pair of converging wedge surfaces formed on the working end of the second member.

5. The archery bow pliers of claim 1 wherein the first member is longer than the second member such that when the first and second members are juxtaposed, the guide means of the first member extends beyond the wedge means of the second member and the wedge means abuts the anvil surface of the first member.

6. The archery bow pliers of claim 1 further comprising clamping means for clamping the split nock ring onto the bow string.

* * * * *